United States Patent [19]

Bubley

[11] Patent Number: 4,524,687

[45] Date of Patent: Jun. 25, 1985

[54] ADJUSTABLE CARRIAGE DRIVE MECHANISM

[75] Inventor: Henry J. Bubley, Deerfield, Ill.

[73] Assignee: American Screen Printing Equipment Company, Chicago, Ill.

[21] Appl. No.: 436,834

[22] Filed: Oct. 26, 1982

[51] Int. Cl.[3] ..... B41L 13/16; B41L 13/02

[52] U.S. Cl. ..... 101/123; 101/126

[58] Field of Search ..... 101/114, 116–120, 101/123, 124, 126, 127, 127.1, 129

[56] References Cited

U.S. PATENT DOCUMENTS

| | | | |
|---|---|---|---|
| 1,589,546 | 6/1926 | Nichols | 101/123 |
| 1,776,459 | 9/1930 | Tull | 101/123 |
| 2,640,415 | 6/1953 | Freeborn | 101/123 |
| 2,894,451 | 7/1959 | Landesman | 101/126 |
| 3,159,100 | 12/1964 | Marquiss | 101/126 |
| 3,166,011 | 1/1965 | Landesman | 101/123 |
| 3,220,344 | 11/1965 | Hagerman | 101/126 |
| 3,237,555 | 3/1966 | Jones | 101/126 |
| 3,731,623 | 5/1973 | Bubley et al. | 101/114 |
| 3,838,639 | 10/1974 | Harwell | 101/123 |
| 3,859,917 | 1/1975 | Bubley et al. | 101/123 |
| 3,955,501 | 5/1976 | Bubley et al. | 101/123 |
| 4,068,579 | 1/1978 | Poo | 101/124 |
| 4,240,343 | 12/1980 | Monvoisin | 101/124 |
| 4,254,708 | 3/1981 | Bubley et al. | 101/123 |

FOREIGN PATENT DOCUMENTS

| | | | |
|---|---|---|---|
| 600212 | 4/1948 | United Kingdom | 118/213 |

*Primary Examiner*—Clyde I. Coughenour

*Attorney, Agent, or Firm*—Fitch, Even, Tabin & Flannery

[57] ABSTRACT

A carriage drive mechanism for a screen printing press includes a stroke adjustment mechanism which enables the length of the printing stroke to be altered quickly and conveniently from the exterior of the press without interrupting operation of the press.

The preferred drive mechanism includes a pivoting drive lever joined to a crank link by a movable connector. Longitudinal displacement of the connector on the drive lever alters the length of the stroke of the drive lever, which alters the length of the printing stroke. The preferred means for displacing the connector includes a threaded rod which is disposed within the drive lever and which extends through a threaded bore in the connector so that rotation of the threaded rod about its longitudinal axis imparts longitudinal motion to the connector.

9 Claims, 4 Drawing Figures

ADJUSTABLE CARRIAGE DRIVE MECHANISM

BACKGROUND OF THE INVENTION

The present invention relates generally to screen printing presses and relates more particularly to an improved carriage drive mechanism for use in a screen printing press.

In a typical screen printing press, ink is applied to a sheet of stock by a squeegee which is carried in reciprocating motion along a printing head by a carriage. Printing occurs as the carriage travels from the front of the head to the rear of the head. Upon reaching the rear of the printing head, the carriage reverses direction and carries the squeegee back to its starting point at the front of the printing head. The path of the carriage from the front to the rear of the printing head is the printing stroke. To produce prints of various lengths, it may be desirable to vary the length of the printing stroke.

Various types of apparatus have been employed in the past for driving the carriage. Such apparatus generally includes an electric motor which transmits motion to the carriage through some type of mechanical linkage.

Various types of systems have been used in the past for adjusting the length of the printing stroke. Electrical sensors have been used to switch on and off the motor which drives the carriage, but electrical stroke control systems have proven unreliable and have additionally been relatively expensive. Pneumatic systems which have been used have also proven unreliable due to problems such as sticking and leakage around air seals.

The most reliable known systems are those wherein the length of the stroke is varied by adjusting the mechanical linkage between the drive motor and the carriage. Typically such an adjustment involves loosening or removing a bolt on a lever arm and replacing and/or retightening the bolt at another location on the lever arm. One mechanism of this type is described in U.S. Pat. No. 3,859,917 to Bubley et al. This type of system, while reliable, had had disadvantages in that adjustment of the stroke requires stopping the press and removing access covers to the linkage inside the machine. The length of the linkage was then changed by shifting the bolt.

Accordingly, it is an object of the present invention to provide a carriage drive mechanism for a screen printing press which provides a convenient and reliable means for altering the length of the printing stroke.

Further objects and advantages of the present invention will become apparent from the following detailed description taken in conjunction with the accompanying drawings in which.

Figure 1:
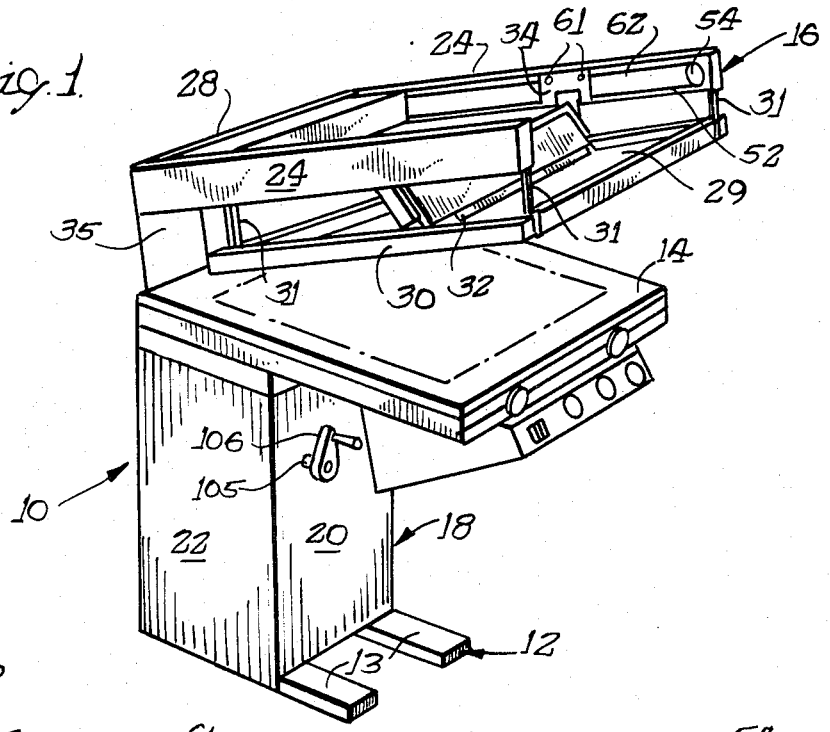
FIG. 1 is a perspective view of a screen printing press embodying a carriage drive mechanism in accordance with the present invention, showing the printing head pivoted upward from its horizontal position.

The present invention is generally embodied in a screen printing press 10 having a press frame, indicated generally at 12, supporting a pivoting printing head 14 and a generally horizontal printing bed 16. The frame includes a pair of horizontal base members 13 and a pair of vertical members 15 (FIG. 2) which are positioned at the rear of the press. The portion of the press beneath the printing bed is enclosed by a housing 18 which includes an upstanding front wall 20 and a pair of upstanding side walls 22 adjacent the front wall. The printing head 14 includes a pair of side members 24 extending along its opposite sides and a rear transverse member 28 which joins the side members 24 at their rear ends. A printing screen 29 stretched in a rectangular screen frame 30 is positioned above the printing bed 16. The screen frame 30 is supported at its four corners by brackets 31 depending from the printing head 14.

During printing the printing head is positioned horizontally above the bed 16 and a squeegee 32 which spans the width of the printing head 14 is carried longitudinally along the printing head over the screen by a carriage 34 which is supported at its opposite ends by the side members 24 of the printing head. The printing head 14 is mounted upon upwardly extending pivot arms 35 which are supported at their lower ends by the upstanding members 15 of the press frame 12 at the rear of the press.

Figure 2:
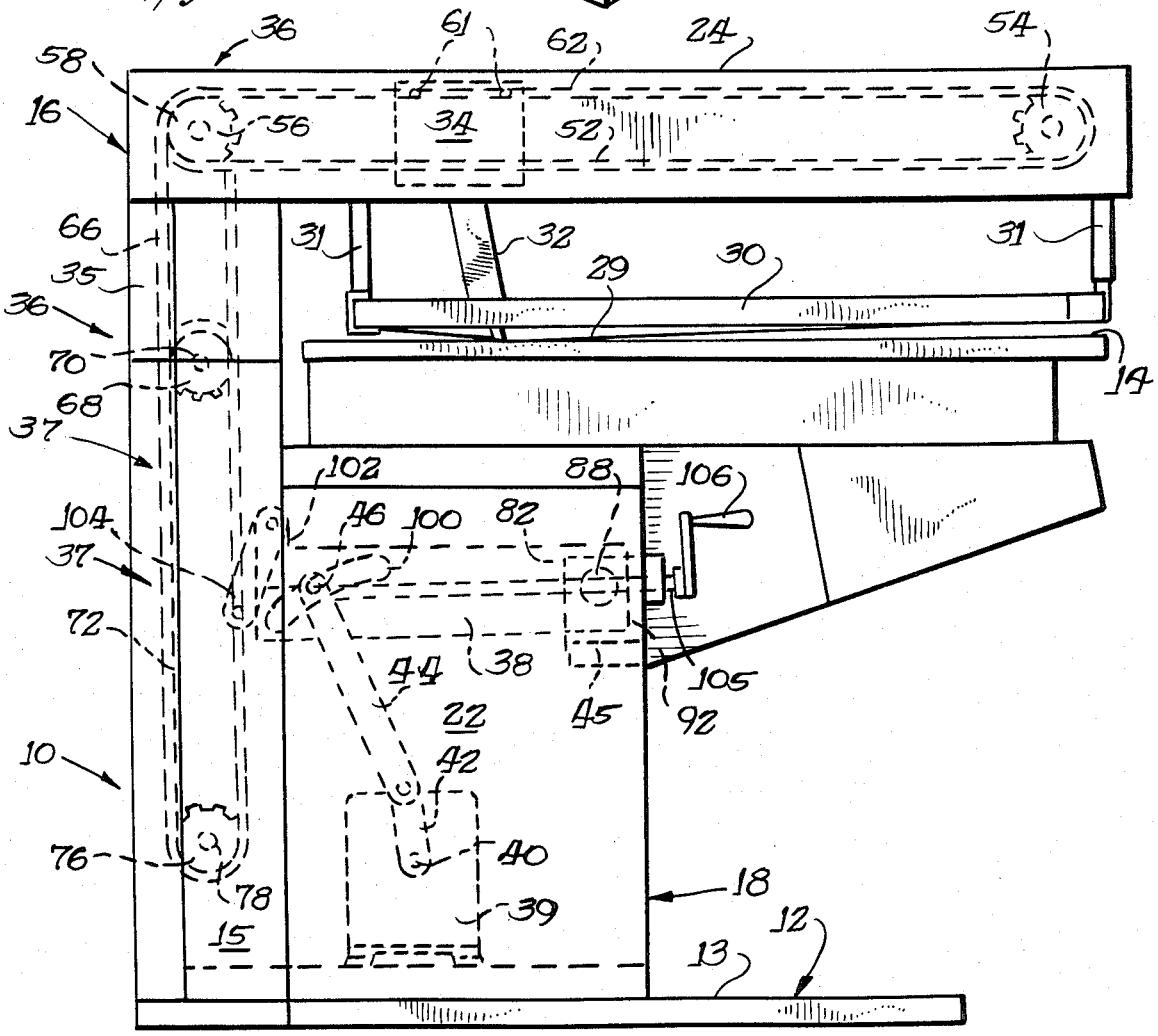
FIG. 2 is a diagrammatic side elevational view of the printing press of FIG. 1, showing the press on an enlarged scale with the printing head in a horizontal position.

The squeegee carriage 34 is shifted forwardly and rearwardly by a carriage drive means 36 which, in this instance, includes a pair of chains 52 to which opposite ends of the squeegee carriage are connected. The cahins 52 run horizontally when the printing head is closed, as seen in FIG. 2, and a vertical drive means 37 including chains 66 and 72 drive the squeegee chains through the printing stroke. The vertical chains 66 and 72 are, in turn, driven through an adjustable linkage means 41 which is driven by a motor drive means comprising a motor 43 and a speed reducer 39.

The conventional linkage means has heretofore been adjustable by stopping the press and removing the access covers to the internal drive of the press and then to adjusting the linkage means usually by unbolting a pivot connection between a crank and lever and then rebolting the crank and lever at a new position so that the movement of the vertical drive means 37 and the carriage drive chains 52 was varied incrementally. Of course, the operator could not view the results of such changes in the linkage and also the resultant variation in printing stroke until the machine was again placed in operation. If further adjustment was desired, the machine had to be stopped and another adjustment made to the linkage.

Herein, the motor means drives the linkage means which includes a pivoted driving lever 38. The driver lever 38 is pivotally mounted on a fixed support 45 at one end and pivotally connected to the chain drive 36 at the opposite end. The drive lever 38 is pivoted by the motor 43 which is connected to a speed reducer 39 which turns a rotating crankshaft 40 with a crank 42 fixed to its end. A crank link 44 connects the crank to the drive lever. The crank link 44 is pivotally connected to a pin 46 projecting from the drive lever at an intermediate point. Rotation of the crankshaft 40 causes the drive lever to pivot, imparting reciprocating motion to the chain drive 36 and thus moving the squeegee 32 and carriage 34 reciprocally along the printing head.

Various types of apparatus have been employed in the past to enable adjustment of the length of the printing stroke, but none of these systems has proven totally satisfactory. Electrical and pneumatic control systems have proven unreliable. Systems wherein stroke adjustment is accomplished by mechanically changing the configuration of the lever mechanism have generally been inconvenient to adjust and have required the operator to stop the press to make the adjustment.

In accordance with the present invention, an improved carriage drive mechanism is provided which is adjustable from the exterior of the press and which enables the stroke length to be altered quickly and conveniently, without interrupting the operation of the press. To this end, means are provided for mechanically altering the configuration of the lever mechanism which transmits power from the crankshaft 40 to the chain drive 36 by displacing a movable connector means including a member 48 longitudinally along the pivoting drive lever 38. In the preferred embodiment, the pin 46 which provides the pivotal connection between the crank link 44 and the drive lever 38 is fixed to the movable connector 48 which is mounted upon a threaded rod 50 disposed longitudinally within the drive lever 38. Rotation of the threaded rod 50 about its longitudinal axis moves the connector 48 longitudinally upon the threaded rod, changing the point at which the crank link 44 is connected to the drive lever 38. The threaded rod 50 is connected to a handle 106 mounted on the exterior of the machine to be turned by the operator who may view the results of the change of the printing stroke. Rotation of the handle 106 changes the length of the stroke of the drive lever 38, and thereby alters the length of the printing stroke. The threaded rod 50 provides a continuous or infinite range of adjustment to enable fine adjustments to be made while the operator watches.

Turning now to a more detailed description of the present invention, the carriage 34 is attached at its opposite ends to the carriage chains 52 which extend the length of the printing head. Each carriage chain is supported by front and rear carriage chain sprockets 54 and 56 respectively. The carriage 34 is attached by pins 61 to an upper portion 62 of each chain 52. The front sprockets are rotatably supported by the side members 24 of the printing head 14. The rear sprockets 56 are fixed to an upper drive shaft 58 which extends across the rear of the printing head 14 and is journaled at its opposite ends through the side members 24.

Figure 3:
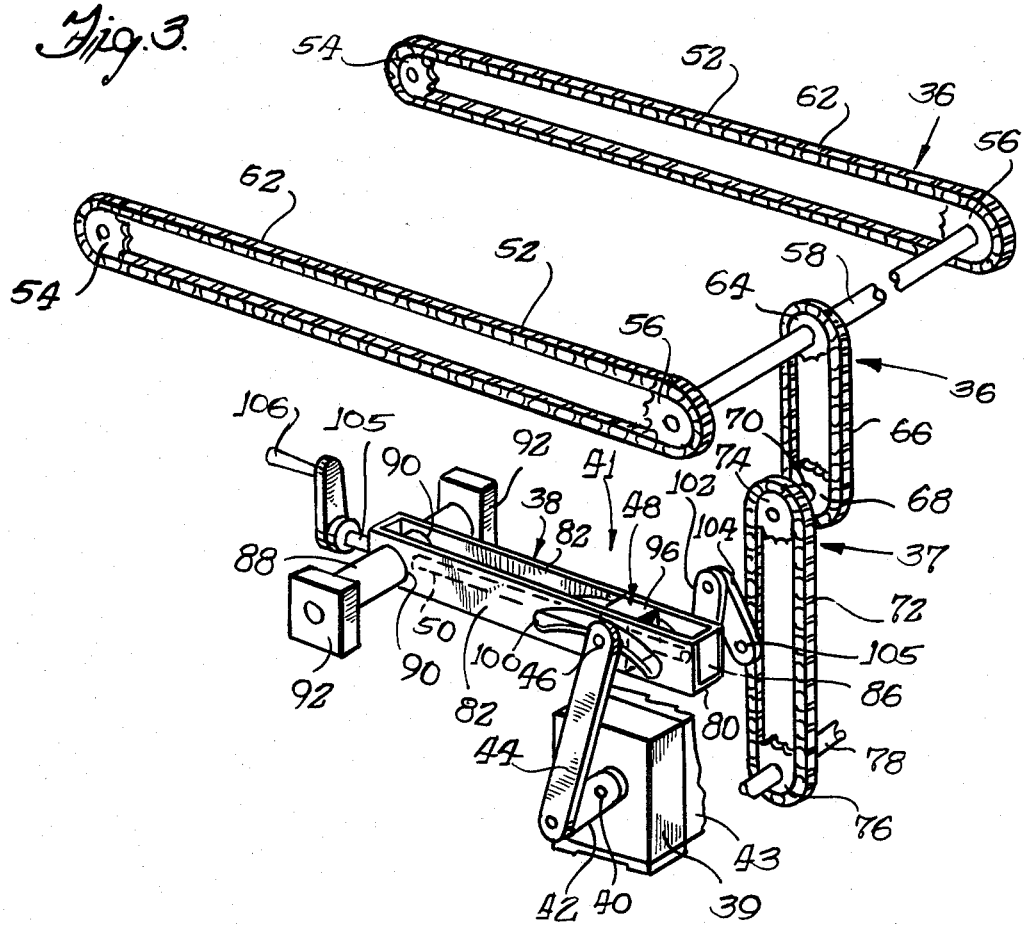
FIG. 3 is a foreshortened diagrammatic perspective view of the carriage drive mechanism of the press of FIG. 1, shown on an enlarged scale.

As best seen in FIG. 3, an upper drive sprocket 64 is fixed to the upper drive shaft 58 between the rear carriage chain sprockets 56 to transmit rotation to the upper drive shaft 58 from an upper drive chain 66 which extends vertically downward from the upper drive sprocket 64 to a first intermediate drive sprocket 68 which is fixed to an intermediate drive shaft 70. The intermediate drive shaft 70 is rotatably supported by the rear frame members 15. A lower drive chain 72 is looped about a second intermediate drive sprocket 74 which is fixed to the intermediate drive shaft 70 and a lower drive sprocket 76 which is fixed to a lower shaft 78 which is rotatably supported at its ends by the frame members 15.

The drive lever 38 herein includes a generally rectangular bottom wall 80 to which are affixed two upwardly extending side walls 82 and an upwardly extending rear wall 86. A generally horizontal shaft 88 extends transversely through circular apertures 90 in the forward ends of the side walls 82 to provide a pivot axis for the drive lever 38. The shaft 88 is rotatably supported at its opposite ends by bearings 92 which are supported by the frame 12. A transverse bore 94 is formed centrally through the shaft 88 to receive the threaded rod 50 which is disposed longitudinally between the side walls 82 of the drive lever 38.

Figure 4:
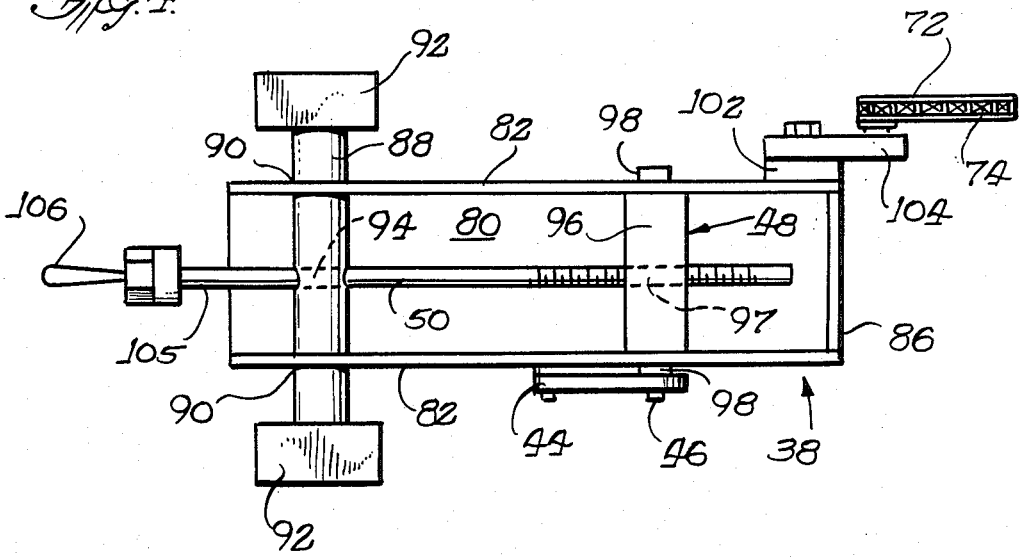
FIG. 4 is an enlarged plan view of the drive lever of the carriage drive mechanism of FIG. 3.

The connector 48 which is mounted on the threaded rod 50 includes a centrally perforated nut 96 having a threaded bore 97 (FIG. 4) to receive the threaded rod 50 and includes a pair of generally cylindrical side lugs 98 which extend outwardly through arcuate slots 100 in the side walls 82 of the drive lever. The pin 46 which provides the pivotal connection between the crank link 44 and the drive lever 38 extends beyond the end of one of the lugs 98. The drive lever 38 is connected to the lower drive chain 72 by an upwardly extending lug 102 which is fixed to the drive lever 38 near the rear of one of the side walls and pivotally attached at its upper end to an upper end of a short link 104. The link 104 is pivotally connected at its lower end by a pin 105 to the lower drive chain 72.

During operation of the press 10, the crankshaft 40 is rotated at a predetermined speed by the motor. The rotation of the crankshaft 40 moves the drive lever 38 in reciprocal pivoting motion between a horizontal position and a downwardly inclined position, thus rotating the drive chains 72 and 66 and carriage chains 52 to transport the carriage 34 reciprocally between the front and the rear of the printing head 14. Printing occurs as the carriage 34 transports the squeegee 32 over the upper surface of the screen 29 toward the rear of the printing head. The drive lever 38 is in the horizontal position when the carriage 34 is at the rearmost position. The drive lever 38 pivots downward as the carriage 34 returns toward the front of the printing head 14.

To adjust the length of the printing stroke, the press operator rotates the threaded rod 50 about its longitudinal axis, moving the connector 48 through the arcuate path defined by the slots 100 in the side walls 82. Moving the connector toward the horizontal shaft 88 lengthens the pivoting stroke. Moving the connector away from the shaft 88 shortens the printing stroke.

In the illustrated embodiment, the front end 105 of the threaded rod 50 extends through the front wall 20 of the press housing 18 so that rotation of the threaded rod 50 may be accomplished by turning an external hand crank 106 which is fixed to the front end of the threaded rod. The threaded rod 50 could alternatively be connected to a gearbox (not shown) and rotated by a crank placed at a different location or by a small electric motor.

The arcuate slots 100 formed in the side walls 82 of the drive lever 38 are configured to position the drive lever in approximately the same position at the end of the printing stroke regardless of the position of the connector 48 on the threaded rod 50 so that alteration of the length of the printing stroke alters the starting position of the carriage without substantially changing the ending position. Thus, variation of the stroke length corresponds to variation of the lowermost pivoted position of the drive lever 38, which corresponds to variation of the starting point of the printing stroke.

The above-described silk screen printing press employes pivoting printing head and employes chains 52 to drive the squeegee carriage through the printing stroke. It is to be appreciated that other silk screen printing presses have printing heads which are pivotal between open and close positions and that the present invention could be used therewith. Further, the illustrated and preferred vertical chains 66 and 72 could be replaced with other mechanical drives. The present invention however is particularly adapted for use with the vertical chain drives as disclosed herein.

From the foregoing it may be seen that the present invention provides an improved adjustable carriage drive mechanism which may be conveniently adjusted from the exterior of the press without interrupting operation of the press and which enables fine adjustments in stroke length to be made. While a preferred embodiment has been shown and described, there is no intent to limit the invention by this disclosure. The invention encompasses all modifications and alternate constructions falling within the spirit and scope of the invention as defined in the appended claims.

What is claimed is:

1. In a screen printing press, the combination of:

a frame, a printing head including a squeegee and printing screen and supported by the frame, a carriage supported by the printing head and movable through a printing stroke to move the squeegee and printing screen relative to each other along the length of the printing head, carriage drive means for moving the carriage through the printing stroke, linkage means comprising a link and lever to provide an operative connection between the drive means and the carriage, said lever being pivotally attached to the link, a movable connector member for joining the link and the lever, the connector member being movable longitudinally upon the lever, stroke adjustment means including means for moving the connector member longitudinally along the lever having a threaded rod which engages the connector member so that rotation of the threaded rod about its longitudinal axis imparts longitudinal motion to the connector member, said stroke adjustment means comprising an exterior operator extending inwardly toward the linkage means so that stroke adjustment may be made from the exterior of the press while the press is in operation, said connector member having a threaded bore formed therethrough and the adjustment means comprising the threaded rod disposed coextensively with the lever and engaging the threaded bore of the connector member so that rotation of the threaded rod displaces the connector member longitudinally with respect to the lever.

2. In a screen printing press, the combination of:

a stationary frame, a pivoted printing head supported by the frame, a screen supported beneath the printing head, a carriage supported by the printing head and movable through a printing stroke along the length of the printing head, the carriage including a squeegee which travels relative to the screen in contact therewith as the carriage travels through the printing stroke, a motor-driven crankshaft comprising a rotating shaft with a crank extending radially outwardly therefrom and fixed thereto, linkage means operatively associating the crankshaft with the carriage comprising a chain drive, a lever pivotally attached at one end to the frame and connected at an opposite end to the chain drive and having a movable connector member, and a link attached at one end to the crank and attached at the other end of the movable connector member, and stroke adjustment means including an exterior operator located on the exterior of the printing press and operatively connected to said link means for moving the connector member longitudinally on the lever to alter the length of the stroke without interrupting operation of the press.

3. A combination in accordance with claim 2 wherein the adjustment means comprises a threaded rod coextensive with the lever arm and means for rotating the threaded rod about its longitudinal axis, the movable connector member having a threaded bore formed through it and being mounted upon the threaded rod so that rotation of the threaded rod displaces the connector member longitudinally upon the threaded rod.

4. A combination in accordance with claim 3 wherein the lever has a hollow interior to receive the threaded rod.

5. A combination in accordance with claim 4 wherein the connector member includes projecting lugs extending from the interior of the lever to the exterior, one of the projecting lugs being connected to the link.

6. In a screen printing press the combination of:

a frame, a pivoted printing head supported by the frame, a screen supported beneath the printing head, a carriage supported by the printing head, spanning the width of the printing head, and movable along the printing head, the carriage including a squeegee which travels along the screen in contact therewith as the carriage travels through the printing stroke, first and second carriage chains extending along opposite sides of the printing head and attached to opposite ends of the carriage, first and second front carriage chain sprockets supporting the carriage chains at the front of the printing head, first and second rear carriage chain sprockets supporting the carriage chains at the rear of the printing head, a transverse drive shaft fixedly supporting the first and second rear carriage chain sprockets, an upper drive sprocket fixedly mounted upon the transverse drive shaft, intermediate drive sprocket means comprising first and second intermediate drive sprockets fixed to a common shaft, an upper drive chain supported upon the first intermediate drive sprocket and the upper drive sprocket, a lower drive sprocket, a lower drive chain supported upon the second intermediate drive sprocket and the lower drive sprocket, a lever pivotally mounted upon the frame, a link connecting the lever to the lower drive chain so that pivoting of the lever imparts motion to the lower drive chain and to the carriage, a motor-driven crankshaft comprising a rotating shaft and a crank extending radially outwardly therefrom and fixed thereto, a linkage operatively connecting the crankshaft to the lever, the linkage comprising a crank link pivotally connected to the crank at one end and pivotally connected to the lever at its opposite end, the lever having a movable connector member for making the pivotal connection to the crank link, and adjustment means to enable the connector member to be moved longitudinally with respect to the lever to permit the length of the printing stroke to be altered without interruption of the operation of the press, the adjustment means comprising a manually accessible handle and displacement means operatively associated therewith.

7. A combination in accordance with claim 6 wherein the adjustment means comprises a threaded rod coextensive with the lever and means for rotating the threaded rod about its longitudinal axis, the movable connector member being mounted upon the threaded rod so that rotation of the threaded rod imparts longitudinal movement to the connector member relative to the lever.

8. A combination in accordance with claim 7 wherein the lever includes a bottom wall, a rear wall extending upward from the bottom wall, and side walls extending upward from the bottom wall and extending forward from the rear wall, the side walls having arcuate slots formed through them, the walls defining a hollow interior to receive the threaded rod.

9. A combination in accordance with claim 8 wherein the connector member of the lever arm has projecting lugs extending outwardly through the arcuate slots to the exterior of the lever arm, one of the projecting lugs being pivotally connected to the crank link.

* * * * *